US010851490B2

(12) United States Patent
Wang

(10) Patent No.: US 10,851,490 B2
(45) Date of Patent: Dec. 1, 2020

(54) DOOR LOCK AND UPPER COVER TYPE WASHING MACHINE

(71) Applicant: Illinois Tool Works Inc., Glenview, IL (US)

(72) Inventor: Yang Wang, Guandong (CN)

(73) Assignee: Illinois Tool Works Inc., Glenview, IL (US)

( * ) Notice: Subject to any disclaimer, the term of this patent is extended or adjusted under 35 U.S.C. 154(b) by 700 days.

(21) Appl. No.: 15/517,646

(22) PCT Filed: Nov. 24, 2015

(86) PCT No.: PCT/CN2015/095426

§ 371 (c)(1),
(2) Date: Apr. 7, 2017

(87) PCT Pub. No.: WO2016/082744

PCT Pub. Date: Jun. 2, 2016

(65) Prior Publication Data

US 2017/0306547 A1 Oct. 26, 2017

(30) Foreign Application Priority Data

Nov. 25, 2014 (CN) ..... 2014 1 0690463

(51) Int. Cl.
*D06F 37/42* (2006.01)
*D06F 39/14* (2006.01)
(Continued)

(52) U.S. Cl.
CPC ..... *D06F 37/42* (2013.01); *D06F 34/28* (2020.02); *D06F 39/14* (2013.01); *E05B 9/02* (2013.01);
(Continued)

(58) Field of Classification Search
CPC ..... E05B 9/02; E05B 47/0004; E05B 47/023; D06F 37/42; D06F 34/28; D06F 39/14;
(Continued)

(56) References Cited

U.S. PATENT DOCUMENTS 3,751,088 A * 8/1973 Schlage ..... E05B 47/0002 292/201
4,237,711 A * 12/1980 Kambic ..... E05B 47/0002 292/223
(Continued)

FOREIGN PATENT DOCUMENTS

CN 1283720 2/2001
CN 1570253 1/2005
(Continued)

OTHER PUBLICATIONS

International Search Report and Written Opinion for PCT/CN2015/095426.

*Primary Examiner* — Kristina R Fulton
*Assistant Examiner* — Faria F Ahmad
(74) *Attorney, Agent, or Firm* — The Small Patent Law Group LLC; Joseph M. Butscher

(57) ABSTRACT

A door lock comprises an electromagnet (410), a latch shaft (320), a crank device (430) and the like. The crank device (430) is connected with the latch shaft (320) and driven by the electromagnet (410) to transform the linear motion of the electromagnet (410) into the rotary motion of the latch shaft (320). When the electromagnet (410) pushes or pulls the crank device (430), a latch head (202) rotates around an axis so that it can move to a locked position or an unlocked position. The door lock (200) of the present invention can transform the linear motion of the electromagnet (410) into the rotary motion of the latch head (202), so that the latch head (202) can be conveniently installed on the lateral surface rather than at an end of the door lock (200). The door
(Continued)

lock (200) can be advantageously installed in the middle gap of a front panel (102) along an edge of a control panel of the washing machine (100) to lock the upper cover (101) from the middle part.

27 Claims, 12 Drawing Sheets

(51) Int. Cl.
*E05B 47/02* (2006.01)
*D06F 34/28* (2020.01)
*E05B 9/02* (2006.01)
*E05B 47/00* (2006.01)

(52) U.S. Cl.
CPC ..... *E05B 47/0004* (2013.01); *E05B 47/023* (2013.01); *Y10S 292/69* (2013.01); *Y10T 292/0945* (2015.04); *Y10T 292/1043* (2015.04); *Y10T 292/1047* (2015.04); *Y10T 292/1061* (2015.04); *Y10T 292/1078* (2015.04); *Y10T 292/1082* (2015.04)

(58) Field of Classification Search
CPC ..... Y10S 292/69; Y10T 292/0945; Y10T 292/1082; Y10T 292/1043; Y10T 292/1047; Y10T 292/1061; Y10T 292/1078
See application file for complete search history.

(56) References Cited

U.S. PATENT DOCUMENTS 4,429,556 A * 2/1984 Kambic ..... E05B 47/0692 70/149
4,627,649 A * 12/1986 Leplat ..... E05B 47/0657 292/216
4,659,884 A * 4/1987 Wollenhaupt ..... E05B 47/0002 200/50.01
4,978,153 A * 12/1990 Hirsch ..... B04B 7/06 292/201
5,004,276 A * 4/1991 Hanley ..... E05C 19/022 292/126
5,072,974 A * 12/1991 Henne ..... E05C 19/022 292/126
RE34,396 E * 10/1993 Wollenhaupt ..... E05B 47/0002 192/135
5,691,520 A * 11/1997 Hapke ..... D06F 37/42 200/61.62
5,852,944 A * 12/1998 Collard, Jr. ..... E05B 47/0002 70/278.7
6,027,148 A * 2/2000 Shoemaker ..... E05B 47/0002 292/201
6,302,455 B1 * 10/2001 Huang ..... E05B 47/0012 292/199
6,363,755 B1 4/2002 Hapke
6,745,603 B1 * 6/2004 Shaw ..... E05B 9/08 70/277
8,757,677 B2 * 6/2014 Wintersteiger ..... E05B 47/023 292/201
2003/0160461 A1 * 8/2003 Promutico ..... D06F 37/42 292/216
2004/0140677 A1 * 7/2004 Hengelein ..... D06F 37/42 292/201
2004/0207210 A1 * 10/2004 Luker ..... E05B 63/0013 292/144
2006/0163884 A1 * 7/2006 Crotti ..... E05B 81/25 292/216
2006/0219499 A1 * 10/2006 Organek ..... B60R 25/005 188/164
2008/0196707 A1 * 8/2008 Chirumbolo ..... E05B 15/101 126/197
2009/0013733 A1 * 1/2009 Rocchitelli ..... D06F 37/42 70/160
2009/0267357 A1 * 10/2009 Hall ..... E05B 63/125 292/99
2010/0139338 A1 * 6/2010 Wintersteiger ..... E05B 47/0607 70/78
2011/0056253 A1 * 3/2011 Greiner ..... B62B 3/1404 70/85
2011/0241359 A1 * 10/2011 Trunk ..... E05B 47/0002 292/196
2011/0241360 A1 * 10/2011 Kitamura ..... E05B 83/34 292/201
2012/0091739 A1 * 4/2012 Ross ..... E05B 47/0047 292/220
2015/0108771 A1 * 4/2015 Barrett ..... E05C 3/12 292/229
2018/0266035 A1 * 9/2018 Wang ..... E05B 47/004
2019/0368106 A1 * 12/2019 Wang ..... D06F 37/42

FOREIGN PATENT DOCUMENTS

CN 101506426 8/2009
CN 102061597 5/2011
CN 102154803 8/2011
CN 102560967 7/2012
CN 205653619 10/2016
CN 105624978 3/2018
DE 20216614 4/2003
JP 2003275495 9/2003
WO WO 2007140755 12/2007

* cited by examiner

DOOR LOCK AND UPPER COVER TYPE WASHING MACHINE

RELATED APPLICATIONS

This application is a National Phase of International Application No. PCT/CN2015/095426, filed Nov. 24, 2015, which relates to and claims priority benefits from Chinese Application No. 201410690463.5, filed Nov. 25, 2014, both of which are hereby incorporated by reference in their entireties.

FIELD OF THE INVENTION

The present invention relates to a door lock for electrical equipment, and particularly relates to a door lock used in an upper cover type washing machine.

BACKGROUND OF THE INVENTION

When a drum of an upper cover type (straight cylinder type) washing machine rotates at a high speed (e.g., in a spin-drying operation), an upper cover needs to be locked for use safety to prevent accidental opening.

A door lock of the upper cover type washing machine also has different performance from that of a drum type washing machine opened from one side due to different use environments, so an electric appliance door lock capable of locking the upper cover of the upper cover type washing machine and solving the problems of water proofing and the like is needed.

SUMMARY OF THE INVENTION

To solve one or more abovementioned technical problems, the present invention provides a door lock which can transform the linear motion of the linear electromagnetic door lock into the rotary motion of a latch head so that the door lock can be transversely arranged at the middle part along the edge of a front panel of a washing machine.

The door lock includes an electromagnet which moves linearly, a latch shaft which rotates around an axis, and a crank device (or eccentric device) which is connected with the latch shaft and driven by the electromagnet to transform the linear motion of the electromagnet into the rotary motion of the latch shaft.

The distal end of the crank device is connected with the electromagnet and the proximal end of the crank device is connected with the latch shaft.

The latch shaft is provided with a latch head extending in a radial direction at an upper end thereof, and when the electromagnet pushes or pulls the crank device, the latch head rotates around the axis so that it moves to a locked position or an unlocked position.

According to aforesaid door lock, a sealing ring is sleeved at the root of a rotating shaft, and the rotating shaft is coaxial or roughly coaxial with the sealing ring.

According to aforesaid door lock, the latch shaft is provided with a spring, which is used for resetting the latch shaft (or the latch head).

The present invention further provides an upper cover type washing machine, which can be locked at the middle part of an upper cover to prevent two sides or one side of the upper cover from being opened during locking.

An upper cover type washing machine includes an upper cover and the aforementioned door lock, which is configured to lock the middle part of the upper cover and placed in parallel to the front edge of the upper cover.

The door lock of the present invention can transform the linear motion of the electromagnet into the rotary motion of the latch head, so that the latch head can be conveniently installed on the lateral surface rather than at an end of the door lock. In particular, the door lock can be installed in the middle gap of a front panel along the edge of the control panel of the washing machine to lock the upper cover from the middle part, and the door lock has a simple structure and can be applied to the existing washing machine without much modification.

DETAILED DESCRIPTION OF THE EMBODIMENTS

Various specific embodiments of the present invention will be described below with reference to the accompanying drawings constituting a part of this description. It should be understood that, although structural parts and components of various examples of the present invention are described by using terms expressing directions, e.g., "front", "back", "upper", "lower", "left", "right" and the like, in the present invention, these terms are merely used for the purpose of convenient description and are determined on the basis of exemplary directions shown in the accompanying drawings. Since the embodiments disclosed by the present invention may be set according to different directions, these terms expressing directions are merely used for describing and should not be regarded as limiting. Under possible conditions, identical or similar reference signs used in the present invention indicate identical components.

Figure 1A:
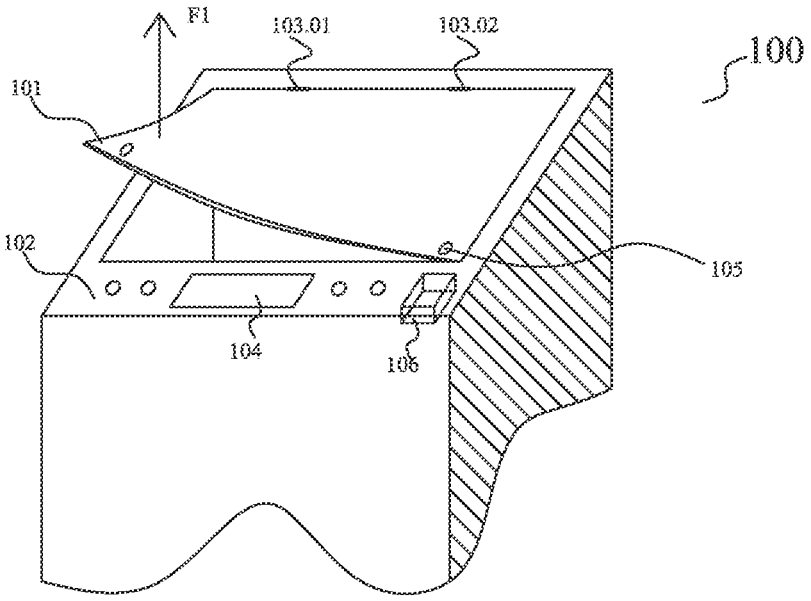
FIG. 1A is a using effect diagram indicating that a door lock in the prior art is installed at one side of an upper cover of an upper cover type washing machine.

FIG. 1A is a using effect diagram illustrating that a door lock is installed at one side of an upper cover of an upper cover type washing machine.

As shown in FIG. 1A, the inventor discovers that an edge of an upper cover 101 of an upper cover type washing machine 100 at one side is movably fixed at the upper part of the washing machine 100 via hinges 103.01 and 103.02 and the right end 105 at the other side is fixed via a door lock 106. A front panel 102 of the washing machine 100 has a limited width and a display screen, a PCB control panel, a manual operation panel and the like need to be installed at the middle part thereof. Thus, the width of the remaining space for installing the door lock is extremely small, only 10-20 mm, as shown by sign A in FIG. 1B. However, the length of the linear electromagnetic door lock 106 is generally 50-60 mm and the lock head stretches out and draws back in the length direction, therefore, the door lock 106 can only be installed on one side end (left end or right end) of the front panel 102 of the washing machine. In such a manner, because a handle is located in the center, one side of the upper cover 101 is locked when the upper cover is lifted at a locked state, then the other side of the upper cover 101 is cocked or partially opened, and the closing effect is poor.

Figure 1B:
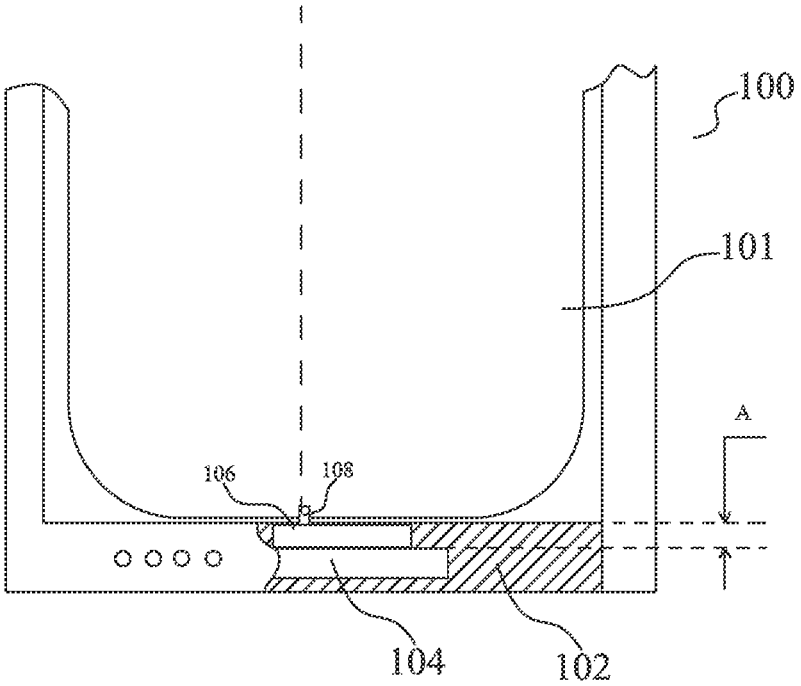
FIG. 1B is a structural schematic diagram indicating that the door lock is installed at the middle part of the upper cover of the upper cover type washing machine.

FIG. 1B is a structural schematic diagram illustrating that the door lock is installed at the middle part of the upper cover of the upper cover type washing machine.

For solving the technical problem of poor closing effect, the door lock 106 needs to be installed at the middle part of the front panel 102 to lock the upper cover 101. The inventor discovers that, due to the size limitation of the linear electromagnetic door lock 106, generally with the length of 50-60 mm, the door lock 106 can only be arranged along an edge of the front panel 102 (arranged transversely) as shown in FIG. 1B. With such an arrangement, the lock head of the door lock 106 has to laterally stretch out and draw back to lock the upper cover, but the lock head 108 of the existing linear electromagnetic door lock 106 stretches out and draws back in the length direction, so the problem that the lock head 108 need to laterally stretches out and draws back cannot be solved by the existing door lock, with reference to the structure as shown in FIG. 1B.

Figure 2A:
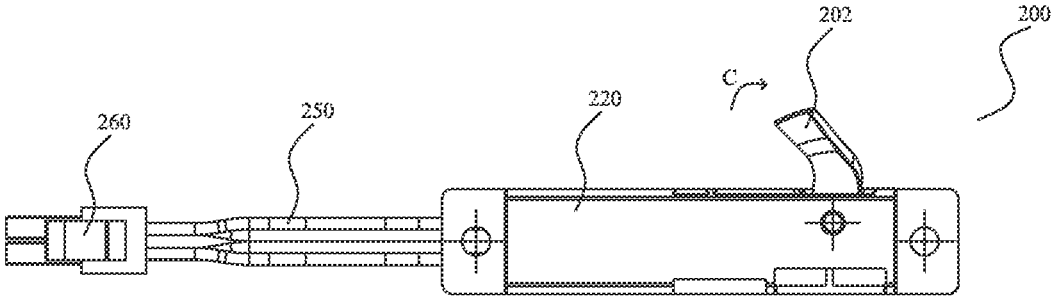
FIG. 2A is a structural top view illustrating a latch head 202 of a door lock 200 of the present invention is opened.

FIG. 2A is a structural top view illustrating a latch head 202 of a door lock 200 of the present invention is opened.

As shown in FIG. 2A, the door lock 200 of the present invention can solve the problem that the latch head 202 stretches out and draws back laterally. The door lock 200 includes a housing 220 and a latch head 202 arranged on a side wall of the housing and an electromagnetically driven electromagnet 410 (see FIG. 4A-FIG. 5B) is arranged within the housing 220 to drive the latch head 202 to rotate. When the latch head 202 rotates out of a groove 310 (see FIG. 3A and FIG. 3B) in the side wall of the housing 220 in the clockwise direction (C direction), it can be inserted into a corresponding hole at a side edge of the upper cover 101, and at the moment, the latch head 202 moves to a locked position to lock the upper cover 101 and the door lock 200 is in a closed state. The door lock 200 further includes wires 250 for transmitting power to the electromagnetically driven electromagnet 410 and sending control signals and a connecting plug 260.

Figure 2B:
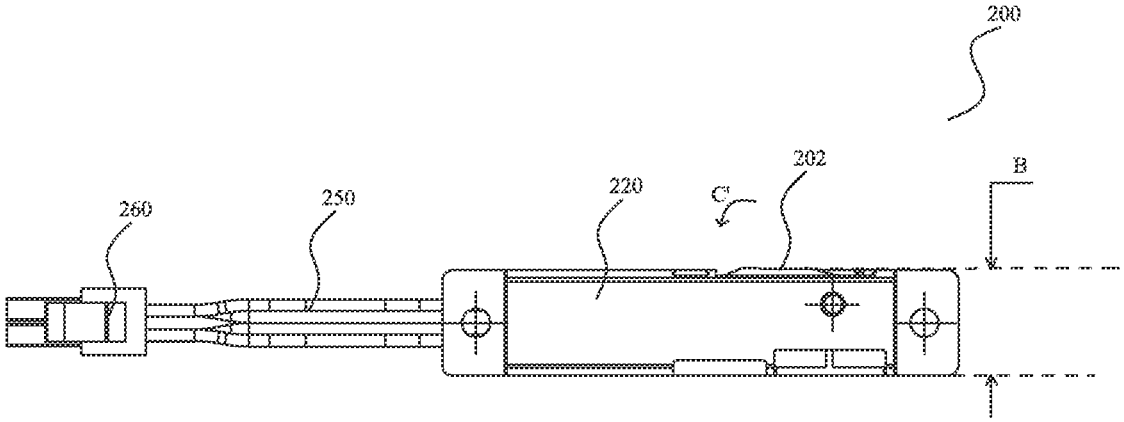
FIG. 2B is a structural top view illustrating the latch head 202 of the door lock 200 of the present invention is closed.

FIG. 2B is a structural top view illustrating the latch head 202 of the door lock 200 of the present invention is closed.

As shown in FIG. 2B, when the latch head 202 rotates into the groove 310 (see FIG. 3A and FIG. 3B) in the side wall of the housing 220 in the anticlockwise direction (C' direction), the latch head 202 moves to an unlocked position, in which the upper cover 101 can be freely opened or closed and the door lock 200 is in an opened state. When the latch head 202 is completely rotated into the groove 310, the door lock 200, the width of which is small, can be completely put into the limited width (about 20 mm) of the front panel 102 of the washing machine 100.

Figure 3A:
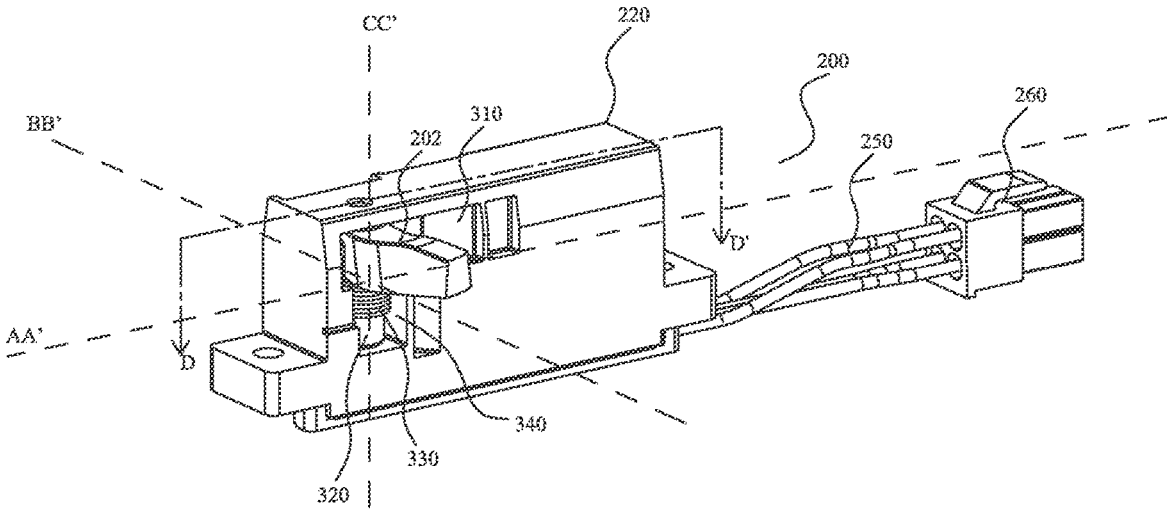
FIG. 3A is a structural stereogram illustrating the latch head 202 of the door lock 200 of the present invention is opened.

FIG. 3A is a structural stereogram illustrating the latch head 202 of the door lock 200 of the present invention is opened.

As shown in FIG. 3A, the door lock 200 includes a housing 220, and a groove 310 for accommodating the latch head 202 at the unlocked position is formed in the side wall of the housing 220. A second cavity 340 is further provided in the side wall of the housing 220 and a latch shaft 320 is accommodated in the second cavity 340. A spring 330 is sleeved at the middle part of the latch shaft 320, and one end of the spring is fixed on an inner wall of the second cavity 340 and the other end is fixed on the latch shaft 320. It can be seen from the figure that, the latch head 202 is sleeved at an upper end of the latch shaft 320 and rotates to and fro (in an included angle of about 90°) between an unlocked position and a locked position with the rotation of the latch shaft 320. FIG. 3A shows the locked position, in which the latch head 202 moves out of the groove 310. A first direction AA', a second direction BB' and a third direction CC', which are orthogonal or roughly orthogonal (roughly orthogonal means slight shift) to one another, are further marked in the figure. The electromagnet 410 (the electromagnet herein is taken as an example for describing, and using other driving element also conforms to the same principle) moves linearly in the first direction AA', the latch shaft 320 stretches in the third direction CC', and the latch head 202 is in the second direction BB' when moving out of the groove 310 and being at the locked position.

Figure 3B:
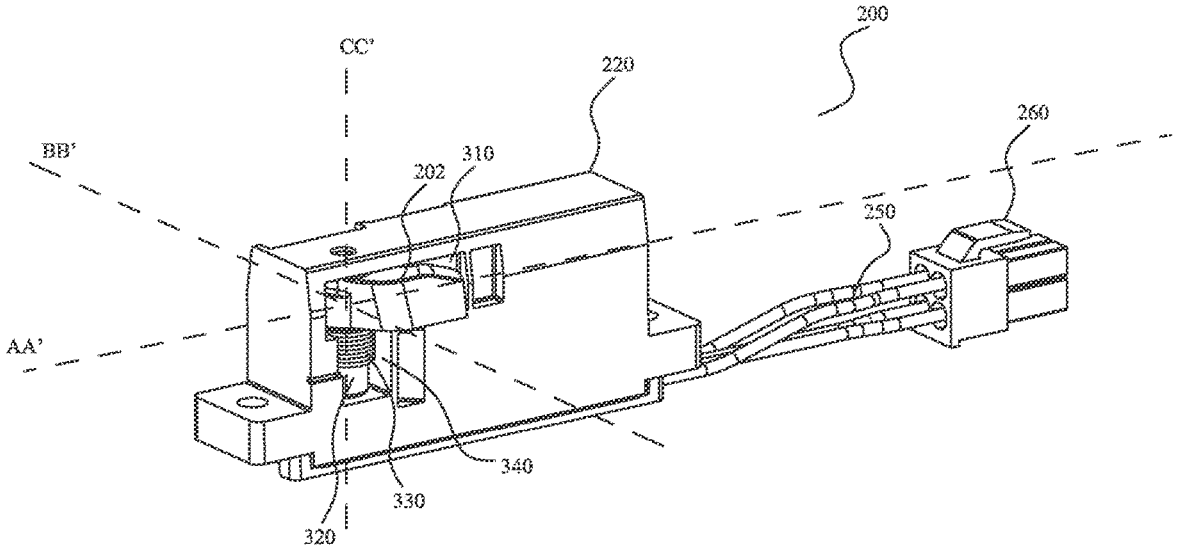
FIG. 3B is a structural stereogram illustrating the latch head 202 of the door lock 200 of the present invention is closed.

FIG. 3B is a structural stereogram illustrating the latch head 202 of the door lock 200 of the present invention is closed.

Figure 4A:
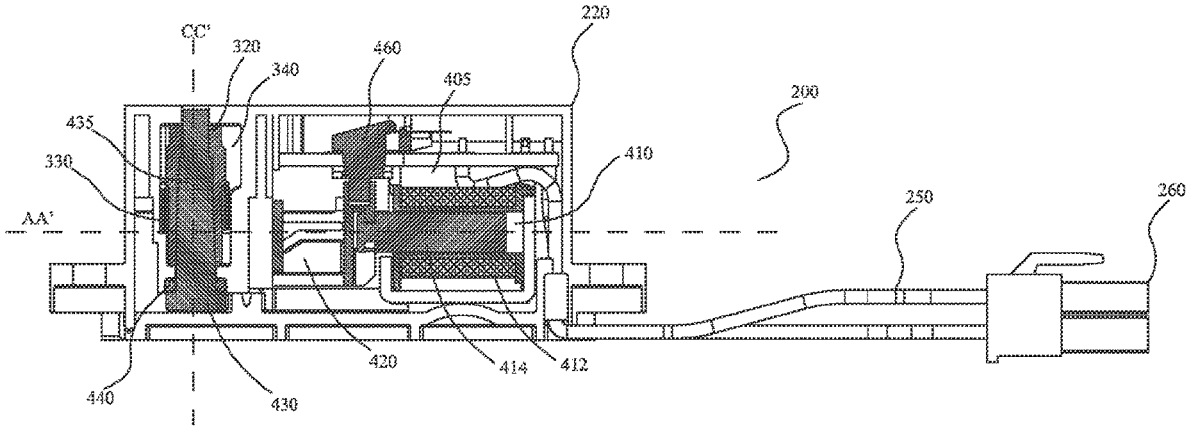
FIG. 4A is a schematic diagram of a profile structure of the door lock 200 of the present invention along the D-D plane of FIG. 3A.

As shown in FIG. 3B, when the latch head 202 is driven by the latch shaft 320 to rotate to the unlocked position, a part of the latch head is embedded into the groove 310. At the moment, the latch head 202 is in (or substantially in) the first direction AA'. FIG. 4A is a schematic diagram of a profile structure of the door lock 200 of the present invention along the D-D plane of FIG. 3A.

As shown in FIG. 4A, the housing 220 of the door lock 200 is provided with a first cavity 405 and a second cavity 340. The electromagnet 410 is accommodated in the first cavity 405, and the latch shaft 320 is accommodated in the second cavity 340 and arranged in the third direction CC'. The electromagnet 410 is provided with a coil 412 and a movable iron core 414 and the movable iron core 414 can move linearly to and fro in the first direction AA'. A distal end the iron core 414 is connected with a slider 420 and drives the slider 420 to move linearly to and fro. A clamping slot, which is provided at the other end of the slider 420, is connected with the distal end (crank end) 432 (see FIG. 4C) of a crank device 430 by clamping, and a proximal end 434 (see FIG. 4C) of the crank device 430 sleeved at a lower end of the latch shaft 320, the latch shaft 320 and the latch head 202 at the upper end of the latch shaft 320 are coaxial (see FIG. 4C). The slider 420 pulls the distal end 432 of the crank device 430 to drive the latch shaft 320 to rotate around an axis such that the latch head 202 sleeved at the upper end of the latch shaft 320 is driven to rotate synchronously.

Figure 4B:
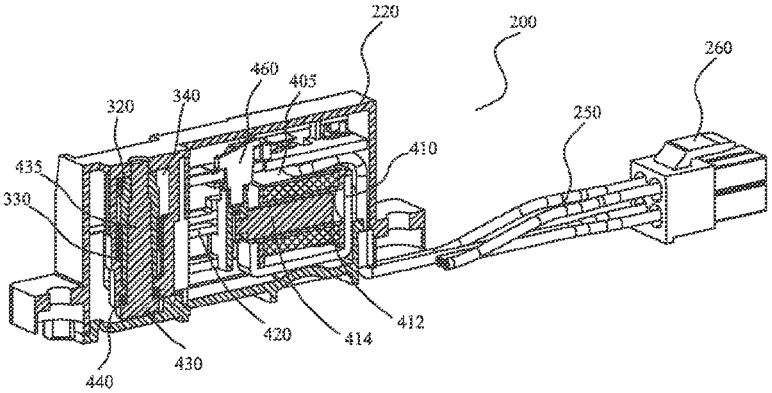
FIG. 4B is a schematic diagram of a profile stereo structure of the door lock 200 of the present invention along the D-D plane of FIG. 3A.

FIG. 4B is a schematic diagram of a profile stereo structure of the door lock 200 of the present invention along the D-D plane of FIG. 3A.

As shown in FIG. 4B, the latch shaft 320 is accommodated in the second cavity 340, and the upper end and the lower end thereof are movably fixed on the housing 220 and can freely drive the latch head 202 (not shown in the figure) to rotate. The proximal end 434 of the crank device 430 is provided with its own rotating shaft 435, two ends of the rotating shaft 435 are movably arranged in the housing 220, and the interior of the latch shaft 320 has a hollow cavity structure and the hollow cavity is sleeved on the rotating shaft 435 such that the hollow cavity and the rotating shaft 435 form a whole and rotate coaxially. An indicating slider 460 is further arranged at the upper end of the slider 420 and moves synchronously with the slider 420. The indicating slider 460 is used for controlling an indicating line at an upper part of the first cavity 405 and the indicating line indicates that the door lock 200 is locked or opened. A waterproof sealing ring 440 (see FIG. 4C) is sleeved at the lower end of the rotating shaft 435 approaching the proximal end 434 of the crank device 430. The sealing ring 440 of the present invention is an O-shaped ring, in fact, can be in any of different shapes, and it is shimmed between the rotating shaft 435 and the housing 220 and is used for preventing water in the second cavity 340 from permeating to the interior of the door lock 200 from the gap between the interior of the housing 220 and the rotating shaft 435 to damage such components as the electromagnet and the like.

Figure 4C:
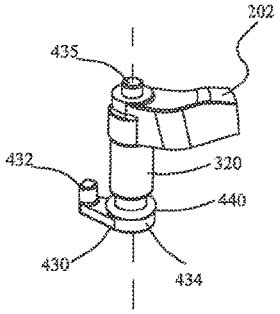
FIG. 4C is a structural stereogram of the latch head 202 of the door lock 200 of the present invention.

FIG. 4C is a structural stereogram of the latch head 202 of the door lock 200 of the present invention.

As shown in FIG. 4C, the latch head 202 sleeved at the upper end of the latch shaft 320, the rotating shaft 435, the lower end of which is the proximal end 434 of the crank device 430, and the latch shaft 320 sleeved on the rotating shaft 435 rotate coaxially. The distal end 432 of the crank device 430 is an eccentric mechanism and is connected with the slider 420 which pulls the distal end 432 of the crank device 430 to drive the latch shaft 320 to rotate around the axis such that the latch head 202 sleeved at the upper end of the latch shaft 320 is driven to rotate synchronously. The sealing ring 440 is sleeved at the root of the rotating shaft 435 close to the crank device 430 for preventing water in the second cavity 340 from permeating to the interior of the door lock 200 to damage components such as the electromagnet and the like. The whole door lock 200 is sealed, only the components in the second cavity 340 are positioned outside the door lock, and the crank device 430 communicates with the interior and the exterior of door lock 200. When the washing machine is used, water is easily sprinkled onto the door lock 200 and easily permeates from the second cavity 340. The sealing ring 440 annularly sleeved at the root of the rotating shaft 435, and the axis of the sealing ring 440 is the same as that of the rotating shaft 435, so the contact area between the sealing ring 440 and the rotating shaft 435 is small. When the rotating shaft 435 is rotating, the frictional resistance of the sealing ring 440 to the rotating shaft 435 is too small to influence the rotation of the rotating shaft 435, and the sealing effect is good.

Figure 5A:
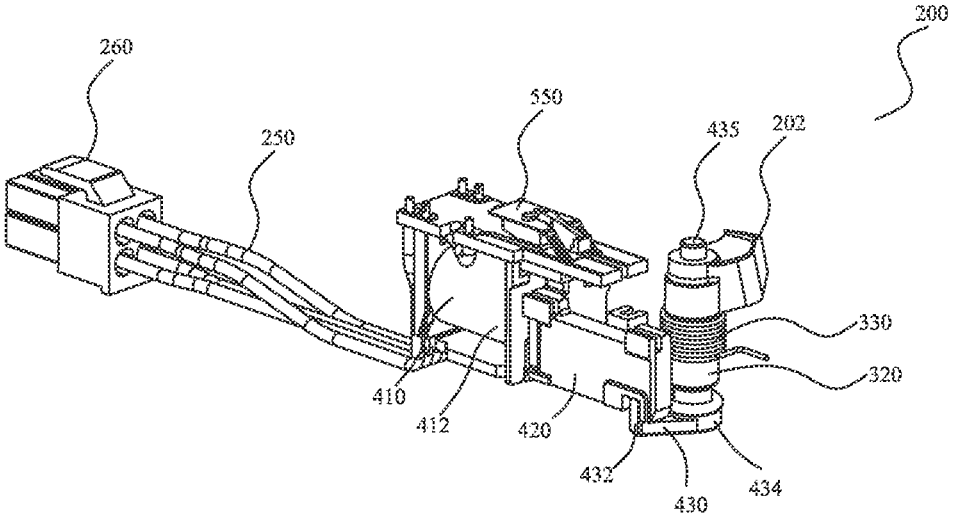
FIG. 5A is a schematic diagram of a stereo structure of the door lock 200 of the present invention, in which a housing 220 of FIG. 3A is removed and the latch head 202 is in an opened state.

FIG. 5A is a schematic diagram of a stereo structure of the door lock 200 of the present invention illustrating the housing 220 of FIG. 3A is removed and the latch head 202 is in an opened state.

As shown in FIG. 5A, the housing 220 of the door lock 200 is omitted, and the electromagnet 410 (the coil 412 is at the exterior), the slider 420, the crank device 430, the distal end 432 of the crank device 430, the proximal end 434 of the crank device 430, the latch shaft 320, the rotating shaft 435, the latch head 202, the spring 330, the wires 250, the connecting plug 260 and the like can be seen from the figure. A switching device 550 is arranged at the upper part of the electromagnet 410. As is shown in the figure, the electromagnet 410 drives the iron core 414 (see FIG. 5B) to draw back so as to pull the slider 420 to move towards the left side of the first direction, and the slider 420 overcomes the elastic force of the spring 330 to drive the crank device 430 and the latch shaft 320 to rotate clockwise, whereby the latch head 202 is driven to rotate for a certain angle and then arrive at an opened state.

Figure 5B:
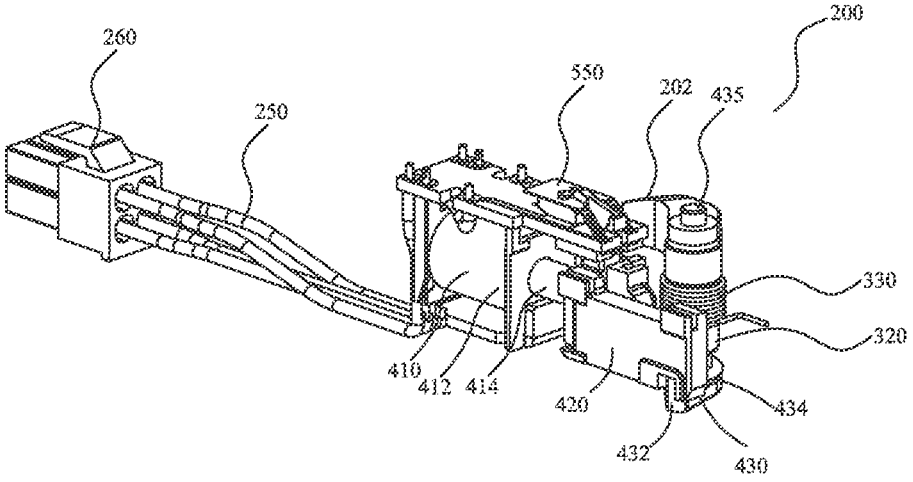
FIG. 5B is a schematic diagram of a stereo structure of the door lock 200 of the present invention, in which the housing 220 of FIG. 3A is removed and the latch head 202 is in a closed state.

FIG. 5B is a schematic diagram of a stereo structure of the door lock 200 of the present invention illustrating the housing 220 of FIG. 3A is removed and the latch head 202 is in a closed state.

Components having structures shown in FIG. 5B that are the same as those in FIG. 5A are no longer described redundantly herein. In the figure, under the elastic force action of the spring 330, the latch shaft 320 rotates anticlockwise along with the crank device 430, the latch head 202 rotates into the groove 310, and then the slider 420 and the iron core 414 move rightwards in the first direction with the anticlockwise rotation of the crank device 430.

Figure 6A:
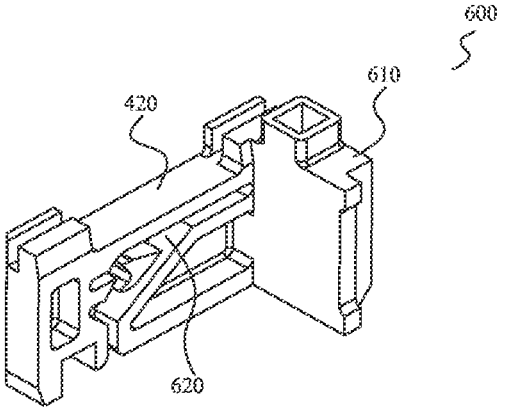
FIG. 6A is a front schematic diagram of a stereo structure of a cartridge mechanism 600 of the door lock 200 of the present invention.

FIG. 6A is a front schematic diagram of a stereo structure of a cartridge mechanism 600 of the door lock 200 of the present invention.

Figure 7A:
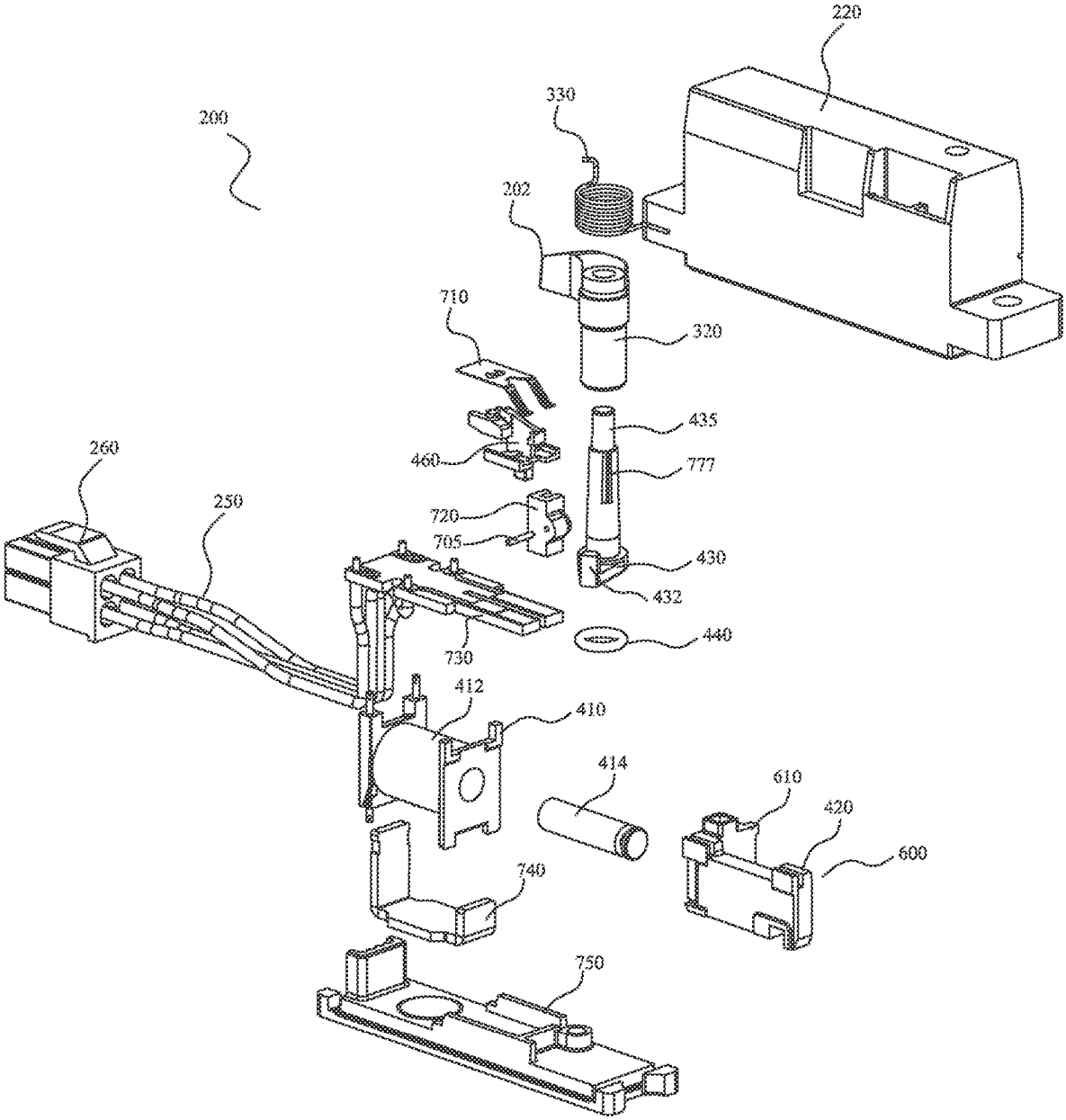
FIG. 7A is a structural explosive view of each component of the door lock 200 of the present invention.
Figure 8A:
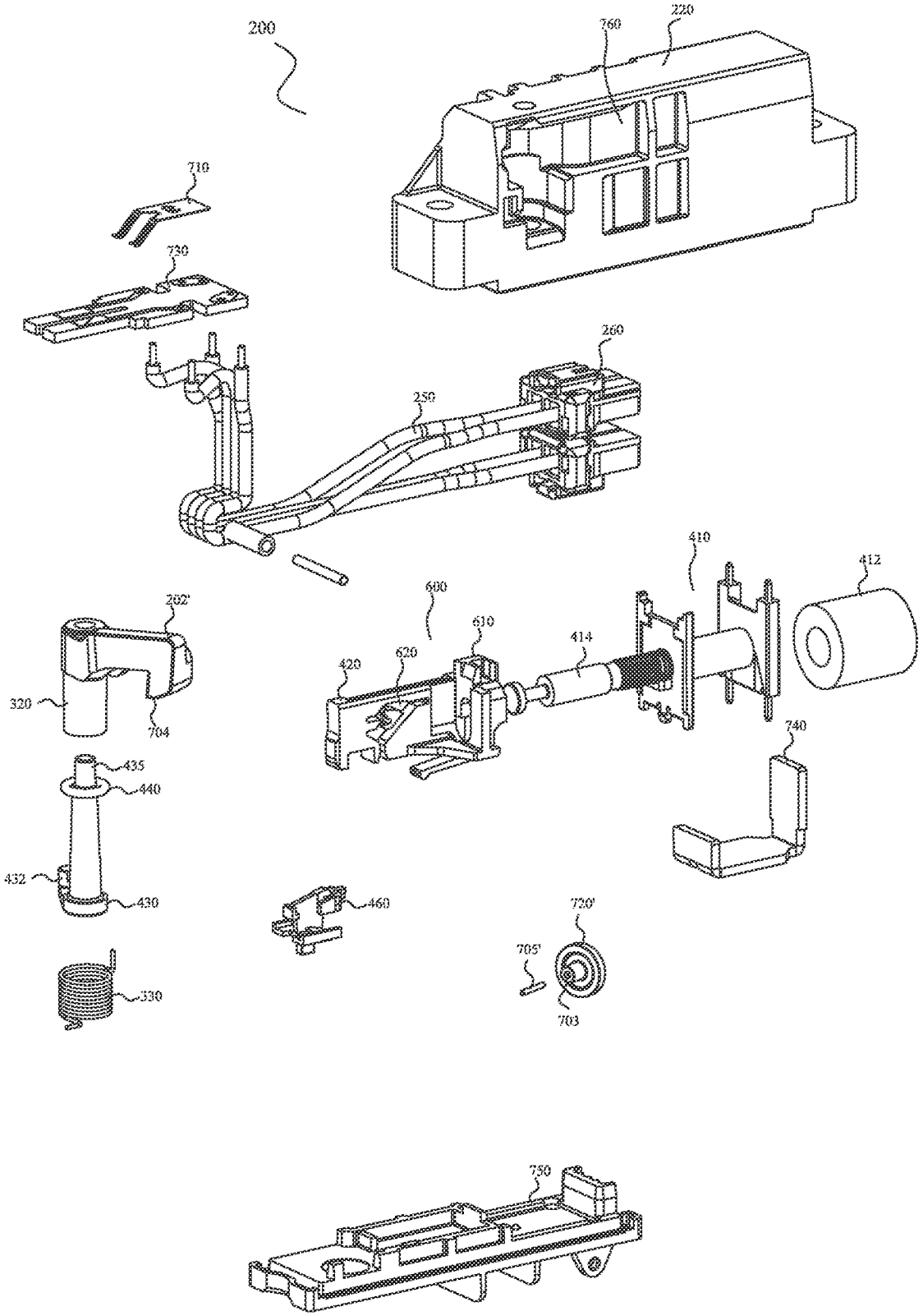
FIG. 8A is a structural explosive view of each component of the door lock 200 in a second embodiment of the present invention.

As shown in FIG. 6A, the cartridge mechanism 600 includes a slider 420 and a fixed block 610 clamped at one side of the slider, and the slider 420 is provided with a heart-shaped track (sliding chute) 620 on a side wall thereof. The function of the cartridge mechanism 600 is similar to that of a ballpoint pen, as described in the following: the electromagnet 410 pulls the slider 420 and then releases the slider 420, whereby the slider 420 moves towards the electromagnet 410 and stays at the side of electromagnet 410 (as shown in FIG. 7A and FIG. 8A and related description below, a steel needle 705 or 705' of a switching slider 720 or 720' moves in the sliding chute 620 to clamp the slider 420, so that the slider 420 stays at the side of electromagnet 410); the electromagnet 410 pulls the slider 420 again and then releases the slider 420, whereby the slider 420 moves towards the crank device 430 under the action of the spring and returns to the side of the crank device 430 (as shown in FIG. 7A and FIG. 8A and related description below, the steel needle 705 or 705' of the switching slider 720 or 720' moves in the chute 620 to release the slider 420, that is to say, the slider 420 is released from the side of the electromagnet 410 so that it moves to the side of crank device 430 under the action of the spring); and the electromagnet 410 pulls the slider 420 again and then releases the slider 420, the pulled slider 420 moves towards the electromagnet 410 again, and stays at the side of electromagnet 410. Then the steps as described above repeats.

Figure 6B:
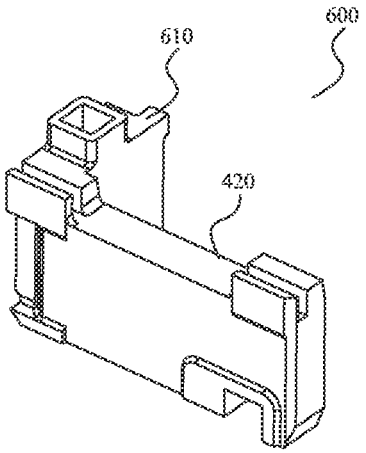
FIG. 6B is a back schematic diagram of a stereo structure of the cartridge mechanism 600 of the door lock 200 of the present invention.

A back schematic diagram of a stereo structure of the cartridge mechanism 600 of the door lock 200 of the present invention is shown in FIG. 6B.

FIG. 7A is a structural explosive view of each component of the door lock 200 of the present invention.

As shown in FIG. 7A, the door lock 200 includes a housing 220, a spring 330, a latch head 202, a latch shaft 320, a crank device 430 (including a rotating shaft 435), a sealing ring 440, a cartridge mechanism 600, a slider 420, an indicating slider 460, a switching shrapnel 710, a switching slider 720, a switching circuit board 730, wires 250, a connecting plug 260, a coil 412, an iron core 414, an electromagnet fixing plate 740, a housing base 750 and the like. The rotating shaft 435 is provided with a number of grooves 777 in the side wall thereof and the latch shaft 320 is provide with a number of pins (not shown in the figure) corresponding to the grooves in the interior thereof. When the latch shaft is sleeved on the rotating shaft 435, the grooves 777 are engaged with the pins so that the latch shaft 320 and the rotating shaft 435 are fixed relative to each other without relative sliding.

Figure 7B:
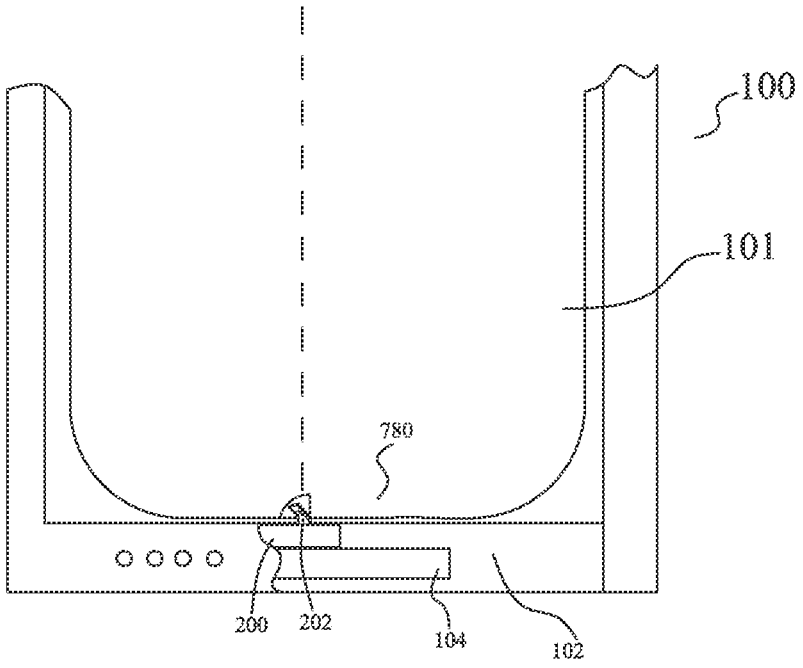
FIG. 7B is a structural schematic diagram illustrating that the door lock 200 of the present invention is applied to the upper cover type washing machine 100.

FIG. 7B is an effect schematic diagram illustrating that the door lock 200 of the present invention is applied to an upper cover type washing machine 100.

As shown in FIG. 7B, the door lock 200 is schematically installed at a position between the edge of the middle part of the front panel 102 of the upper cover type washing machine 100 and a control circuit board 104 (manual operation board). The body of the door lock 200 is parallel to the edge of the upper cover 101, and the latch head 202 can be rotated out of the door lock 200 to be inserted into a corresponding hole 780 of the upper cover 101 so as to lock the upper cover 101. Such a manner of being locked at the middle part can avoid cocking two sides or one side of the upper cover 101. The door lock 200 transforms the linear motion of the iron core 414 of the electromagnet 410 into rotary motion of the latch head 202 laterally opened and closed so that the door lock 200 with the width of about 15 mm can be installed in a 20 mm-wide space from the edge of the front panel 102 to solve the technical problem of locking the upper cover 101 at the middle part.

FIG. 8A is a structural explosive view of each component of the door lock 200 in a second embodiment of the present invention.

As the second embodiment of the present invention, the structure of the door lock 200 is substantially the same as that in the first embodiment shown in FIG. 7A; and the difference lies in the structure of the switching slider 720 and the latch head 202. As shown in FIG. 7A and FIG. 8A, the switching slider 720 is of block type and the latch head 202 is not provided with a hook in FIG. 7A, while the switching slider 720' is of roller wheel type, the latch head 202' is further provided with a downward hook 704, and a groove 760 for accommodating the retracted hook 704 is formed in the side wall of the housing 220 in FIG. 8A. Other structures in FIG. 8A are completely the same as those in the first embodiment shown in FIG. 7A and are not described redundantly herein.

In FIG. 7A, the switching slider 720 is of block type and is provided with a jack in the middle part thereof. One end of a steel needle 705 can be inserted into the jack and the other end of the steel needle 705 is inserted into the sliding chute 620. When the slider 420 is driven to move to and fro by the electromagnet 410, the steel needle 705 moves along different paths in the sliding chute 620 to clamp and release the slider 420.

In FIG. 8A, the switching slider 720' is designed in roller-wheel form and is provide with a jack 703 in the middle thereof. One end of a steel needle 705' can be inserted into the jack 703 and the other end of the steel needle 705' is inserted into the sliding chute 620. When the slider 420 is driven to move to and fro by the electromagnet 410, the steel needle 705' moves along different paths in the chute 620 to clamp and release the slider 420. Compared with the block type switching slider 720, the roller-wheel type switching slider 720' can both slide and roll in the cartridge mechanism 600, whereby the flexibility that internal components of the cartridge mechanism 600 move is improved.

In the first embodiment, the latch head 202 which is not provided with a hook can lock the straight plate type upper cover 101 as shown in FIG. 1A, FIG. 1B and FIG. 7B. However, many folding cover type washing machines are difficult to be locked by the latch head 202 without a hook because the covers can be folded and contracted.

The latch head 202' shown in FIG. 8A is further provided with a downward hook 704. When the latch head 202' rotates and stretches into a locked position, the hook 704 can slide into a sliding chute 810 (see FIG. 8B and FIG. 8C) in the edge of the upper cover 101 and can be clamped at the inside of the chute wall 812. Such a manner can prevent the folding upper cover 101 from contracting, and thus the folding type upper cover 101 being safely locked. When the latch head 202' rotates into an unlocked position, it contracts into the chute 760 formed in the side wall of the housing 220.

Figure 8B:
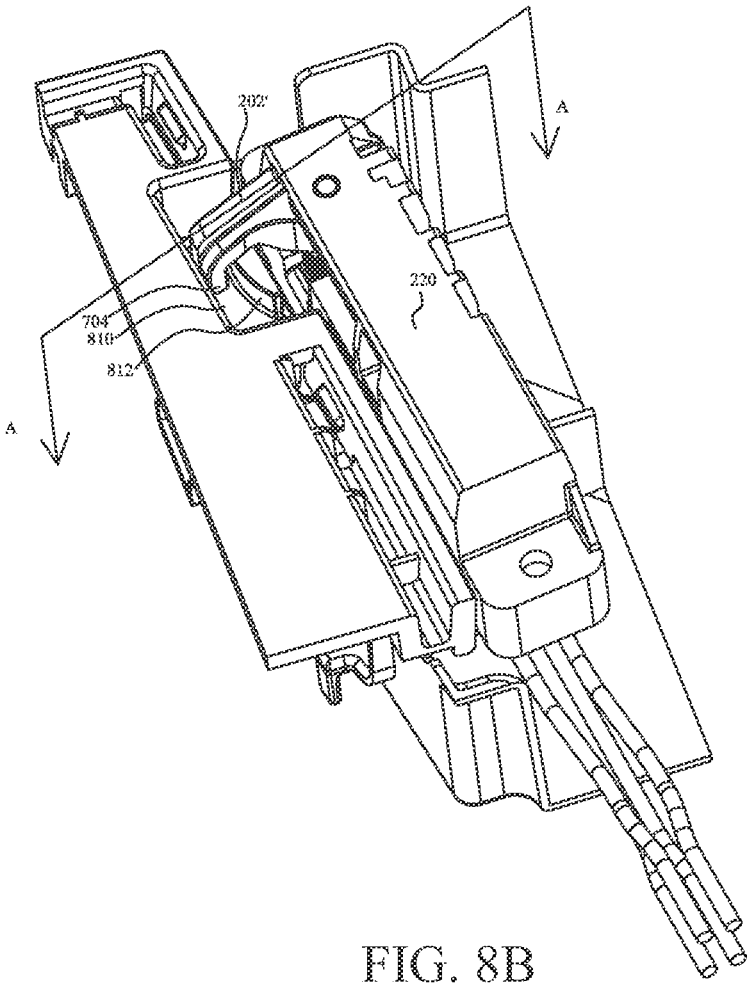
FIG. 8B is a schematic diagram illustrating a latch head 202' of the door lock 200 in the second embodiment of the present invention is in an operating state.
Figure 8C:
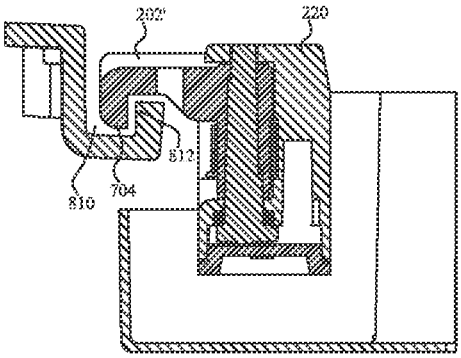
FIG. 8C is a profile view of FIG. 8B along the AA plane.

FIG. 8B is a schematic diagram of a working state of the latch head 202' of the door lock 200 of the present invention in the second embodiment. FIG. 8C is a profile view of FIG. 8B along the AA plane.

As shown in FIG. 8B and FIG. 8C, the latch head 202' is provided with a downward extending hook 704, and the edge of the upper cover 101 is provided with a sliding chute 810 which allows the hook to slide therein and is provided with a side wall 812 at the outer side thereof. When the cover plate needs to be locked, the electromagnet 410 drives the latch head 202' to rotate and stretch into the locked position, the hook 704 may slide into the sliding chute 810 (see FIG. 8B and FIG. 8C) of the edge of the upper cover 101, and the hook 704 may be clamped at the inside of the side wall 812 and hooks the inner wall of the side wall 812, so that the upper cover 101 cannot be opened.

Figure 9A:
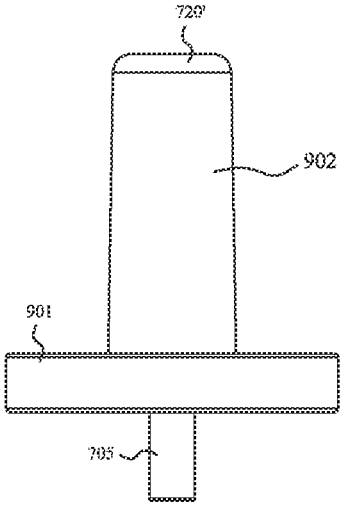
FIG. 9A is a structural schematic diagram of a switching slider 720' of the door lock 200 in the second embodiment of the present invention.
Figure 9B:
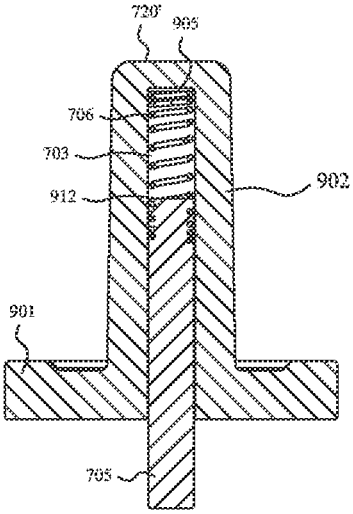
FIG. 9B is a structural profile view of the switching slider 720' of the door lock 200 in the second embodiment of the present invention.

FIG. 9A and FIG. 9B are structural schematic diagrams of the switching slider 720' of the door lock 200 in the second embodiment of the present invention.

As shown in FIG. 9A and FIG. 9B, the switching slider 720' is designed in roller wheel form. A front end of the switching slider 720' is a disc 901 and the rear end of the switching slider 720' is a sleeve 902 which is hollow and closed at its bottom. The center of the disc is provided with a jack 703, which directly reaches the bottom of the sleeve 902. A steel needle (pin) 705 is inserted into the jack 703, and a spring 706 is arranged between one end 912 of the steel needle 705 and the inner bottom 905 of the sleeve 902. The other end of the steel needle 705 is inserted into the sliding chute 620 (as shown in FIG. 8A), and the spring 706 enables the steel needle 705 to closely press the bottom of the sliding chute 620 all the time. the bottom of the sliding chute 620 is provided with guiding steps (not shown in the figures) matched with the steel needle and these steps can assist the motion trail of a guiding roller wheel, so that the steel needle 705 moves along different paths in the sliding chute 620 and may not slide out of the sliding chute 620 to move on a wrong path.

Figure 10A:
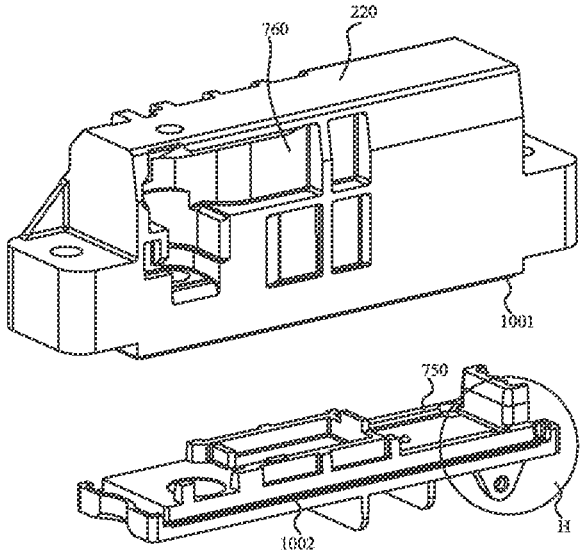
FIG. 10A is a structural schematic diagram indicating that the housing 220 of the door lock 200 of the present invention is buckled with a housing base 750.

FIG. 10A is a structural schematic diagram indicating that the housing 220 of the door lock 200 of the present invention is buckled with the housing base 750.

It should be noted that the door lock 200 of the present invention is applicable to an impeller type (swirl type) washing machine or a double-cylinder washing machine, and the doors of drums of the two kinds of washing machines are at the upper parts of the washing machines. Different from a drum type washing machine of which the drum door is arranged on the lateral side of the washing machine, the waterproof level of the drum door is set to be relatively high in order to prevent water from leaking from the lateral side. Since no water leaks from the interior of the drum door into the use environment of an electric appliance door lock, the door lock itself does not need a too high waterproof requirement. Whereas, the door lock 200 of the present invention is arranged at the upper cover of the washing machine, and the waterproof setting of the drum door is not too high because water normally does not flow out from the upper part of the drum. But when water and clothes pass through an opening above the drum, the door lock is directly exposed in a environment with water, and when the drum rotates at a high speed or wet clothes pass by the door lock, water is easily permeated into the interior of the door lock, so such an electric appliance instead needs a higher requirement for the waterproof property of the door lock itself. In order to achieve the sealing effect, as mentioned above, the housing of the entire door lock 200 is completely sealed, the sealing ring 440 is further arranged at the root of the crank device 430 which is the only part communicated with the inside and the outside, and then water can be completely prevented from entering the interior of the door lock 200.

FIG. 10A shows the housing 220 of the door lock 200 and the housing base 750 in FIG. 7A and FIG. 8A are in a separated state, and they are in the states as shown in FIG. 3A and FIG. 3B when being buckled. The housing base 750 is provided with upward edges 1002 on four sides. The housing 220 is a groove that is hollow in its interior and downward turned, and the notch of the groove is provided with a downward edge opening 1001 (not fully shown in the figure). During installation, after the internal components of the door lock 200 are installed, the housing 220 is buckled with the housing base 750 so that the edge opening 1001 of the housing 220 is closely engaged with the edges 1002 of the housing base 750, meanwhile, an ultrasonic welding technology can be adopted to melt and bond the edge opening 1001 and the edges 1002 together so that the door lock 200 is formed to a closed cavity.

This weld sealing manner of directly welding the contact surfaces of the housing and the base reduces components such as buckles, screws and the like which are needed for mechanical sealing. Meanwhile, a better waterproof sealing effect is achieved, and a sealing washer is not needed. The door lock has a simple structure, consumables are reduced, and the manufacturing process in installation and assembly of the door lock 200 is simplified.

Figure 10B:
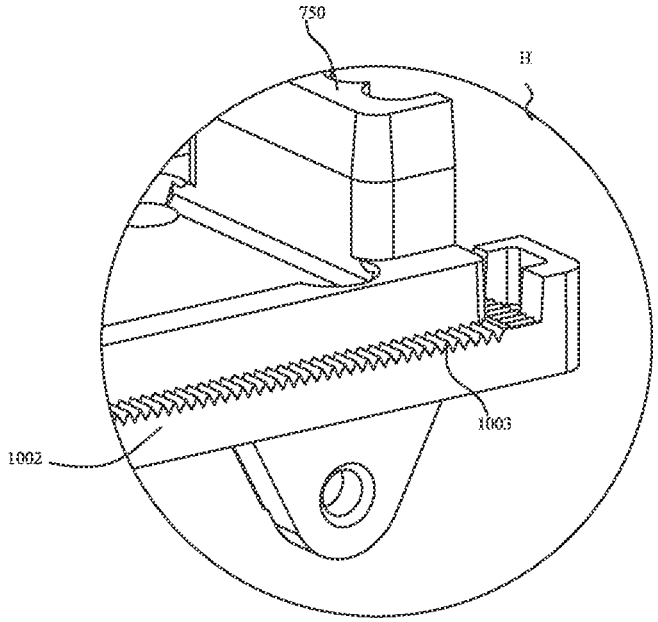
FIG. 10B is a partial enlarged view of an H area on the housing base 750 of the door lock 200 of the present invention.

FIG. 10B is a partial enlarged view of an H area on the housing base 750 of the door lock 200 of the present invention.

As can be seen from FIG. 10B, the surface of the edge 1002 of the housing base 750 is formed by triangular saw-toothed arrises 1003, in fact, the surface of the edge opening 1001 of the housing 220 is formed by a triangular arris edge 1004 (not shown in the figure) along the edge 1002, and the contact surfaces of the arris edge and the saw teeth are easily melted when an ultrasonic welding is used. The arrises of the arris edge 1004 are perpendicular to those of the saw teeth 1003, and when the edge 1002 contacts the edge opening 1001, two crossed arrises contact only at one point and the melted saw teeth 1003 and arris edge 1004 are more easily inserted into each other during intersecting.

Although the present invention is described with reference to the specific embodiments shown in the accompanying drawings, it should be understood that, the door lock of the present invention may have many variation forms without departing from the spirit, scope and background of the present invention. Those of ordinary skill in the art could conceive of different manners to change the parameters in the embodiments disclosed by the present invention, e.g., size, shape or type of elements or materials, and all these manners fall into the spirit and scope of the present invention and the claims.

The invention claimed is:

1. A door lock, comprising:

an electromagnet including an iron core, wherein the iron core is configured to move linearly;

a slider coupled to an end of the iron core, wherein the iron core is configured to move the slider;

a latch shaft, which rotates around an axis;

a crank device coupled to the slider and the latch shaft, wherein the crank device is driven by the electromagnet to transform the linear motion of the electromagnet into the rotary motion of the latch shaft; and a waterproof sealing structure comprising:

a housing;

a housing base, wherein the housing and the housing base are buckled with each other to form a closed cavity which is used for accommodating the electromagnet, the latch shaft and the crank device; and a sealing ring, wherein the crank device is connected with the latch shaft through a rotating shaft the rotating shaft is movably arranged by the housing; and the sealing ring is sleeved at the root of the lower end of the rotating shaft and is shimmed between the rotating shaft and a housing.

2. A door lock, comprising:

an electromagnet, which moves linearly;

a latch shaft, which rotates around an axis;

a slider;

a crank device coupled to the electromagnet by the slider, wherein the crank device is connected with the latch shaft through a rotating shaft, and wherein the crank device is driven by the electromagnet to transform the linear motion of the electromagnet into the rotary motion of the latch shaft; and a waterproof sealing structure including a housing and a sealing ring, wherein the sealing ring is sleeved at the root of the lower end of the rotating shaft and is shimmed between the rotating shaft and the housing.

3. The door lock of claim 2, wherein the latch shaft is provided with a latch head extending in a radial direction at an upper end thereof; and when the electromagnet pushes or pulls the crank device, the latch head rotates around the axis so that the latch head moves to a locked position or an unlocked position.

4. The door lock of claim 3, wherein the electromagnet moves linearly in a first direction, the latch shaft extends in a second direction, and the first direction is orthogonal to the second direction.

5. The door lock of claim 4, wherein the latch head points to a third direction when moving to the locked position; and the first direction, the second direction and the third direction are orthogonal to one another.

6. The door lock of claim 5, comprising a housing containing a cavity;

wherein the electromagnet is placed within the cavity of the housing in the first direction; and the latch shaft is arranged in the second direction.

7. The door lock of claim 6, wherein when the door lock is at an opened position, the latch head is positioned within the cavity of the housing; and when the door lock is at a closed position, the latch head moves out of the cavity of the housing.

8. The door lock of claim 6, wherein the side portion of the housing of the door lock is provided with a groove; the latch head is partially positioned in the groove when moving to the unlocked position; and the latch head rotates out of the groove when moving to the locked position.

9. The door lock of claim 6, wherein the cavity of the housing comprises a first cavity and a second cavity; the electromagnet is placed in the first cavity in the first direction, and the latch shaft is placed in the second cavity in the second direction.

10. The door lock of claim 2, wherein a fixed block is clamped to one side of the slider.

11. The door lock of claim 2, further comprising a switching slider;

wherein a steel needle is arranged at the middle part of the switching slider, a sliding chute is provided in one side wall of the slider, and the steel needle is inserted into the sliding chute; and wherein the switching slider releases and clamps the slider when moving within the sliding chute.

12. The door lock of claim 11, wherein the switching slider is of block type.

13. The door lock of claim 11, wherein the switching slider is of roller wheel type.

14. The door lock of claim 8, wherein the latch head is provided with a hook extending downwards.

15. The door lock of claim 13, wherein a front end of the switching slider is a disc and the rear end of the switching slider is a hollow sleeve, a jack is formed in the center of the disc, and the jack directly reaches a bottom of the sleeve; and wherein a steel needle is inserted into the jack, a spring is arranged between one end of the steel needle and the inner bottom of the sleeve, and the spring enables the other end of the steel needle to be always closely inserted into the sliding chute.

16. The door lock of claim 1, wherein the housing base is provided with upward edges on four sides, and the housing is provided with downward edge openings on four sides; and the edges and the edge openings are buckled with each other.

17. The door lock of claim 16, wherein a surface of the edge is formed by triangular saw-toothed arrises engaged with each other; and a surface of the edge opening is formed by a triangular arris edge perpendicular to the triangular saw-toothed arrises.

18. The door lock of claim 16, wherein the edges are melted and bonded together with the edge openings.

19. The door lock of claim 6, wherein the housing contains a cavity; the electromagnet is placed within the cavity of the housing in the first direction; and the latch shaft is arranged in the second direction.

20. An upper cover type washing machine, comprising an upper cover; and the door lock according to claim 2;

wherein the door lock is configured to lock a middle part of the upper cover and placed in parallel to a front edge of the upper cover.

21. The upper cover type washing machine of claim 20, wherein an operation board of the upper cover type washing machine are placed at the back of the door lock.

22. The door lock of claim 20, wherein a sliding chute capable of allowing a hook to slide therein is provided in the edge of the upper cover; and wherein when the latch head rotates into the locked position, the hook rotates and slides into the chute to lock the upper cover.

23. The door lock of claim 2, wherein a distal end of the crank device is connected with the electromagnet by a clamping slot to the slider, and a proximal end of the crank device is connected with the latch shaft.

24. The door lock of claim 2, wherein the waterproof sealing structure further includes a housing base, wherein the housing and the housing base are buckled with each other to form a closed cavity which is used for accommodating the electromagnet, the latch shaft and the crank device.

25. The door lock of claim 24, wherein the housing base is provided with upward edges on four sides, and the housing is provided with downward edge openings on four sides; and the edges and the edge openings are buckled with each other.

26. The door lock of claim 25, wherein a surface of the edge is formed by triangular saw-toothed arrises engaged with each other; and a surface of the edge opening is formed by a triangular arris edge perpendicular to the triangular saw-toothed arrises.

27. The door lock of claim 25, wherein the edges are melted and bonded together with the edge openings.

* * * * *